US008848958B2

(12) United States Patent
Karlsen

(10) Patent No.: US 8,848,958 B2
(45) Date of Patent: Sep. 30, 2014

(54) HEARING AID RETAINER ACCESSORY

(71) Applicant: Oticon A/S, Smørum (DK)

(72) Inventor: Morten Friis Karlsen, Smørum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 13/659,525

(22) Filed: Oct. 24, 2012

(65) Prior Publication Data

US 2013/0294627 A1 Nov. 7, 2013

Related U.S. Application Data

(60) Provisional application No. 61/550,926, filed on Oct. 25, 2011.

(30) Foreign Application Priority Data

Oct. 25, 2011 (EP) ..... 11186420

(51) Int. Cl.
*H04R 25/00* (2006.01)

(52) U.S. Cl.
CPC ..... *H04R 25/65* (2013.01); *H04R 2225/021* (2013.01); *H04R 2225/63* (2013.01); *H04R 25/60* (2013.01); *H04R 25/602* (2013.01)
USPC ..... 381/330; 381/322; 381/374; 381/381

(58) Field of Classification Search
USPC ..... 381/322, 330, 374, 381
See application file for complete search history.

(56) References Cited

U.S. PATENT DOCUMENTS

| | | | | |
|---|---|---|---|---|
| 3,327,807 | A | 6/1967 | Mullin | |
| 4,702,345 | A | 10/1987 | Janssen et al. | |
| 4,881,616 | A | 11/1989 | Janssen et al. | |
| 4,918,757 | A | 4/1990 | Janssen et al. | |
| 6,748,094 | B1 | 6/2004 | Tziviskos et al. | |
| 7,013,018 | B2 | 3/2006 | Bøgeskov-Jensen | |
| 7,142,926 | B2 | 11/2006 | Crawford | |
| 7,450,732 | B2 * | 11/2008 | Kragelund | 381/323 |
| 7,602,929 | B2 * | 10/2009 | Topholm et al. | 381/322 |
| 8,442,252 | B2 * | 5/2013 | Meosky et al. | 381/324 |
| 2007/0217641 | A1 | 9/2007 | Rosal | |
| 2008/0002849 | A1 * | 1/2008 | Tan | 381/330 |
| 2008/0273732 | A1 | 11/2008 | Fickweiler et al. | |
| 2008/0298619 | A1 | 12/2008 | Kral et al. | |

FOREIGN PATENT DOCUMENTS

| | | | |
|---|---|---|---|
| DE | 100 48 337 | C1 | 3/2002 |
| WO | WO 2004/112431 | A1 | 12/2004 |
| WO | WO 2009/049617 | A1 | 4/2009 |
| WO | WO 2009/083007 | A2 | 7/2009 |

* cited by examiner

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

A hearing aid retainer accessory is provided for use with a hearing aid having a housing with a longitudinal end face portion comprising a mechanical connection terminal and an electrical connection point. The hearing aid retainer accessory comprises a retainer element with a first end face portion having a first mechanical connection means configured to be engageable to a mechanical connection terminal of a longitudinal end face portion of a housing of a hearing aid.

11 Claims, 7 Drawing Sheets

HEARING AID RETAINER ACCESSORY

CROSS REFERENCE TO RELATED APPLICATIONS

This nonprovisional application claims the benefit of U.S. Provisional Application No. 61/550,926 filed on Oct. 25, 2011 and to Patent Application No. 11186420.3 filed in the European Patent Office on Oct. 25, 2011. The entire contents of the above applications are hereby incorporated by reference.

BACKGROUND OF THE INVENTION

The invention is related to a hearing aid retainer accessory for retaining a BTE (behind-the-ear) hearing aid at a user's ear.

In order to operate at best and to prevent damage resulting from falling of the ear and dropping to the ground, a BTE-hearing aid has to be kept in a safe position at a user's ear. Also if the user's head moves intensely such as it may do by doing sport. Another example is a child playing.

US 2007/0217641 A1 discloses a hearing aid protection accessory formed by a flexible sleeve to be wrapped around a housing of a hearing aid, the flexible sleeve to be connected to a users clothing via a clip and a cord. Suitable for preventing the hearing aid from dropping to the ground this arrangement, however, does not allow an adjustment to a user's ear and is likely to entangle with all kinds of obstacles a child may encounter playing. Also the sleeve adds to the thickness of the hearing aid housing rendering it difficult to be placed behind a small ear.

U.S. Pat. Nos. 4,881,616 and 4,702,345 each disclose a hearing aid retainer accessory that is formed by a tube with a respective sleeve connected to each end, both sleeves pulled over the housing of the hearing aid. The arrangement disclosed in U.S. Pat. No. 4,881,616 allows an adjustment to a user ear by moving the sleeves toward or away from each other on the housing of the hearing aid. The degree of adjustment, however, is limited by the longitudinal dimension of the hearing aid housing. The sleeves of both U.S. Pat. Nos. 4,881,616 and 4,702,345 add to the thickness of the hearing aid housing, resulting in a discomfort to wear or even the ears protruding, provided they are still in a process of growth. Furthermore, the sleeves are likely to interfere with a control button located at the surface of the hearing aid housing.

U.S. Pat. No. 7,013,018 B2 discloses an adjustable earring for a headset, the earring being connected via a pivotal link to a housing of a speaker included in the headset.

Finally, U.S. Pat. Nos. 4,918,757 and 3,327,807 each disclose an arrangement for retaining a hearing aid at a user's head utilizing a head band. Undesirably each of the arrangements exerts an uncomfortable force to the users head and is rather noticeable.

It is therefore an object of the present invention to provide a hearing aid retainer accessory which avoids the disadvantages of prior art devices and is intuitive and easy to attach, comfortable to wear, free of interference with a hearing aid's control buttons and the specially designed hearing aid geometry, all while retaining a hearing aid at a user's ear safely and stably.

A hearing aid in the scope of the present invention is a BTE-hearing aid or a BTE-like-hearing aid.

SUMMARY OF THE INVENTION

According to a first aspect of the present invention the technical object is achieved by a hearing aid retainer accessory for use with a hearing aid having a housing with a longitudinal end face portion comprising a mechanical connection terminal and an electrical connection point, wherein the hearing aid retainer accessory comprises a retainer element with a first end face portion having a first mechanical connection means configured to be engageable to a mechanical connection terminal of a longitudinal end face portion of a housing of a hearing aid.

Engageable or engaged to a hearing aid via a battery drawer, the hearing aid retainer accessory is free of interference with a hearing aid's control buttons and the specially designed hearing aid geometry. Furthermore, the hearing aid retainer accessory is very intuitive and easy to attach to a hearing aid.

The first mechanical connection means can be shaped as a hook-like protrusion. The hook-like protrusion can be fitted to a complementary cut-out region embodied by a mechanical connection terminal of a longitudinal end face portion of hearing aid's housing. When said first mechanical connection means is connected to said mechanical connection terminal, the hook-like protrusion is accommodated in the cut-out region, providing a very stable mechanical connection.

In a preferred embodiment the retainer element comprises a second end face portion having a second mechanical connection means. The second mechanical connection means are configured to engage a mechanical connector of an accessory component's connector portion. In this way an accessory component can be mechanically connected to a hearing indirectly, once a hearing aid's mechanical connection terminal is occupied by the first mechanical connection means of the hearing aid retainer accessory.

In a further embodiment the first and the second end face portion comprise a respective first and second electrical connection means electrically connected to each other. The first electrical connection means is configured to engage an electrical connection point of a longitudinal end face portion of a hearing aid's housing. The second electrical connection means is configured to engage an electrical connector of accessory component's connector portion. In this way an electric/electronic accessory component like an FM-transmitter can be electrically connected to a hearing indirectly, once a hearing aid's electrical connection point is occupied by the first electrical connection means of the hearing aid retainer accessory. The first and/or second electrical connection means can be configured as connection points to allow a very reliable electrical connection.

To be versatile in terms of mechanical connectivity, the second mechanical connection means can be formed as a cut-out region being complementary to the first mechanical connection means.

In a preferred embodiment the first end face portion has a surface area of roughly the same size as a longitudinal end face portion of a hearing aid's housing. The first end face portion can have a surface area of roughly the same size as an accessory component's connector portion. The first and the second end face portion can have a surface area of roughly the same size. By tailoring the first and second and face portion such, a nearly seamless shape between a hearing aid's and/or an accessory component's housing and the hearing aid retainer accessory can be achieved once they are connected.

To provide ergonomic shape when worn, the first and the second end face portion can face away from each other.

According to a second aspect of the present invention the technical object is achieved by a hearing aid accessory unit modularly formed of a hearing aid retainer accessory comprising a retainer element with a first and a second end face portion having a respective first and second mechanical connection means, wherein the first mechanical connection means is configured to be engageable to a mechanical connection terminal of a longitudinal end face portion of a hearing aid's housing, and of an accessory component having a connector portion with a mechanical connector engaged to said second mechanical connection means.

In a preferred embodiment the first and the second end face portion comprise a respective first and second electrical connection means electrically connected to each other. The first electrical connection means is configured to engage to an electrical connection point of a longitudinal end face portion of a hearing aid's housing. The second electrical connection means is engaged to an electrical connector comprised by the accessory component's connector portion. The first electrical connection means and the second electrical connection means can be provided as connection points.

The first mechanical connection means and the mechanical connector can be identically shaped a as a hook-like protrusion fitted to a cut-out region embodying the second mechanical connection means. The first and the second end face portion can face away from each other. The first and the second end face portion can have a surface area of roughly the same size as the connector portion.

According to a third aspect of the present invention the technical object is achieved by a hearing aid assembly modularly formed of a hearing aid having a housing with a longitudinal end face portion comprising a mechanical connection terminal and an electrical connection point, of a hearing aid retainer accessory comprising a retainer element with a first and a second end face portion having a respective first and second mechanical connection means, wherein the first mechanical connection means is engaged to the mechanical connection terminal, and of an accessory component having a connector portion with a mechanical connector engaged to said second mechanical connection means.

In a preferred embodiment the first and the second end face portion comprise a respective first and second electrical connection means electrically connected to each other. The first electrical connection means is engaged to the electrical connection point. The second electrical connection means is engaged to an electrical connector comprised by the accessory component's connector portion. The accessory component can thus be supplied with electrical energy/signals from the hearing aid or can supply electrical energy/signals to the hearing aid. The first electrical connection means and the second electrical connection means can be provided as connection points.

The first mechanical connection means and the mechanical connector can be identically shaped a as a hook-like protrusion fitted to a cut-out region embodying the second mechanical connection means and the mechanical connection terminal. This provides for a sturdy mechanical connection throughout the hearing aid assembly.

In order to be worn ergonomically the first and the second end face portion can face away from each other. The first and the second end face portion can have a surface area of roughly the same size as the connector portion and/or the longitudinal end face portion. This provides for the hearing aid's assembly to have a seamless outer surface and hence a high comfort in wear.

Alternatively the hearing aid assembly can be modularly formed of a hearing aid having a housing with a longitudinal end face portion comprising a mechanical connection terminal and of a hearing aid retainer accessory comprising a retainer element with a first portion having a first mechanical connection means, wherein the first mechanical connection means is engaged to said mechanical connection terminal. In this way, the hearing aid assembly is especially compact.

In a preferred embodiment related to all three aspects of the invention the retainer element has a hook-like shape. In light of experience a hook-like shape is especially discreet and comfortable to wear. The retainer element can be configured to be deformable. Provided as a straight elongated portion it can be bent into a desired shape fitting the user's ear geometry best. The retainer element can be spring-like. This has the advantage that the retainer element returns into its original position after having been pushed out for attachment. To provide an especially robust wear for children, the retainer element can be provided a closed ring going all the way around the ear, the ring being elastic or non-elastic. Alternatively the retainer component can be configured to have a firm shape.

DETAILED DESCRIPTION

Figure 1:
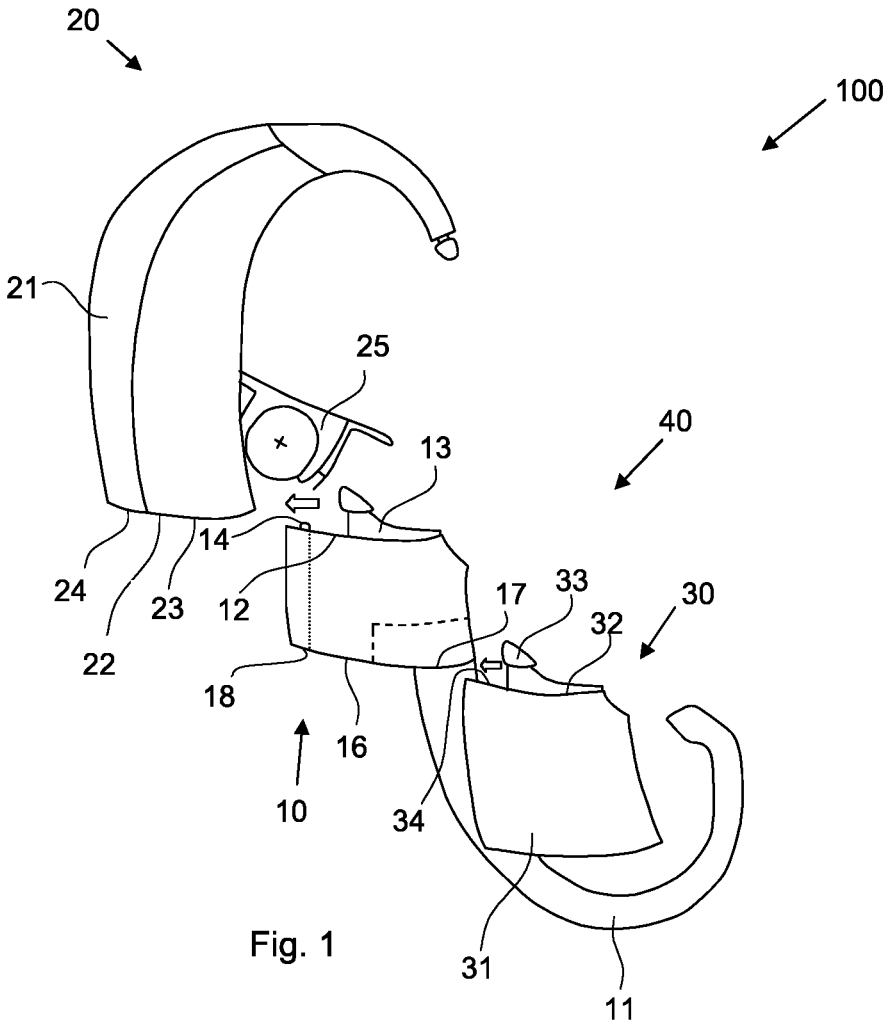
FIG. 1 schematically depicts a side view of a hearing aid retainer accessory according to the invention.

FIG. 1 shows a hearing aid 20, a hearing aid retainer accessory 10 and an accessory component 30. The hearing aid 20 is designed as a BTE hearing aid with a housing 21 having a longitudinal end face portion 22. The longitudinal end face portion 22 comprises a mechanical connection terminal 23 and an electrical connection point 24.

The hearing aid retainer accessory 10 comprises a retainer element 11 with a firm hook-like shape. The retainer element 11 has a first end face portion 12 with a first mechanical connection means 13 having a hook-like protrusion being engageable to a mechanical connection terminal 23, which is designed as a cut-out region (to be seen best in FIG. 2), of a longitudinal end face portion 22.

Furthermore, the retainer element 11 comprises a second end face portion 16 having a second mechanical connection means 17 shaped as cut-out region complementary to the first mechanical connection means 13 (to be seen best in FIG. 2) The first mechanical connection means 13 and the mechanical connector 33 are identically shaped as a hook-like protrusion fitted to a cut-out region embodying the second mechanical connection means 17. Hence, said second mechanical connection means 17 is engageable to said mechanical connector 33, while also being connectable to the mechanical connection terminal 23.

The first and the second end face portion 12, 16 comprise a respective first and second electrical connection means 14, 18 electrically connected to each other. The first electrical connection means 14 is configured as connection points to engage to an electrical connection point 24 of a longitudinal end face portion 22 of a hearing aid's 20 housing 21, the second electrical connection means 18 is configured as connection points being configured to engage to an electrical connector 34 of accessory component's 30 connector portion 32.

The first and the second end face portion 12, 16 faces away from each other and have a surface area of roughly the same size. Furthermore, the first end face portion 12 has a surface area of roughly the same size as the longitudinal end face portion 22 of the hearing aid's 20 housing 21 and the same size as the accessory component's 30 connector portion 32.

To form a hearing aid accessory unit 40 modularly, the accessory component 30 is connected to the hearing aid retainer accessory 10 by a sliding on motion (indicated by direction arrow next to the mechanical connector 33). If connected, the mechanical connector 33 is engaged to the second mechanical connection means 17 and the electrical connector 34 is connected to the second electrical connection means 14. Since the first and second electrical connection means 14, 18 are electrically connected to each other, and electrical connector 34 is connected to the second electrical connection means 18, the electrical connector 34 is also in electrical connection with the first electrical connection means 14.

A Hearing aid assembly 100 is modularly formed by connecting the hearing aid 10, the hearing aid retainer accessory 20 and the accessory component 30 by sliding said components onto each other (indicated by direction arrow next to the mechanical connector 33 and first mechanical connection means 13). For connection, a battery drawer 25 of the hearing aid 20 is in an open position. If connected, the first mechanical connection means 13 is engaged to the mechanical connection terminal 23 and the mechanical connector 33 is engaged to the second mechanical connection means 17. Furthermore, the first electrical connection means 14 is engaged to the electrical connection point 24 and the second electrical connection means 18 is engaged to the electrical connector 34 comprised by the accessory component's 30 connector portion 32.

Figure 2:
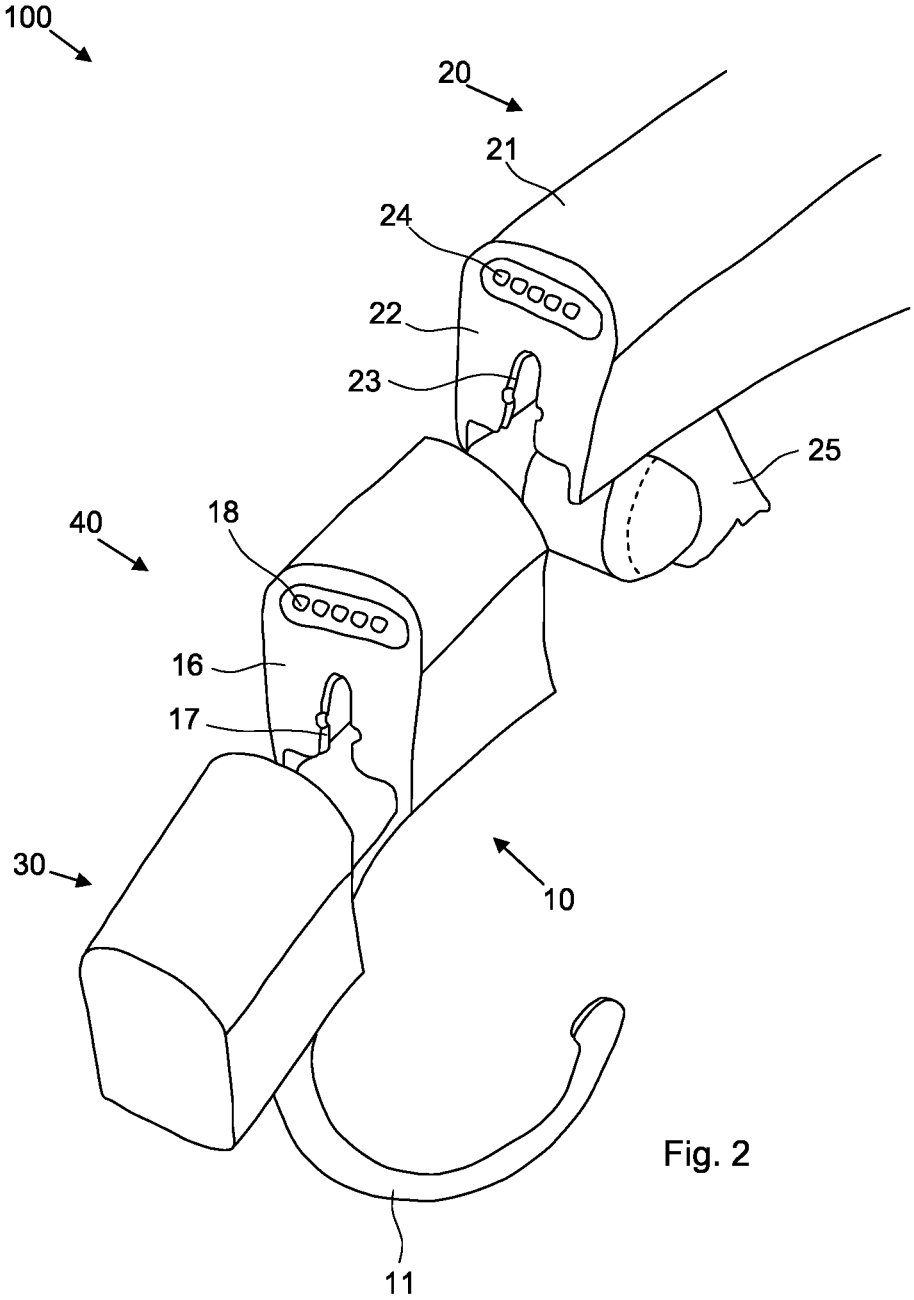
FIG. 2 shows a perspective view of the arrangement of FIG. 1.

FIG. 2 shows a perspective view of the arrangement of FIG. 1 to especially provide a better understanding of the second mechanical connection means 17 and the mechanical connection terminal 23, both being configured as a cut-out region being complementary to the first mechanical connection means 13 and the mechanical connector 33 described with respect to FIG. 1. The connection point 24 is configured as connection points being placed on the same surface, namely the longitudinal end face portion 22, as the mechanical connection terminal 23. The second electrical connection means 18 are configured as connection points placed on the same surface, namely the second end face portion 15, as the second mechanical connection means 17.

Figure 3:
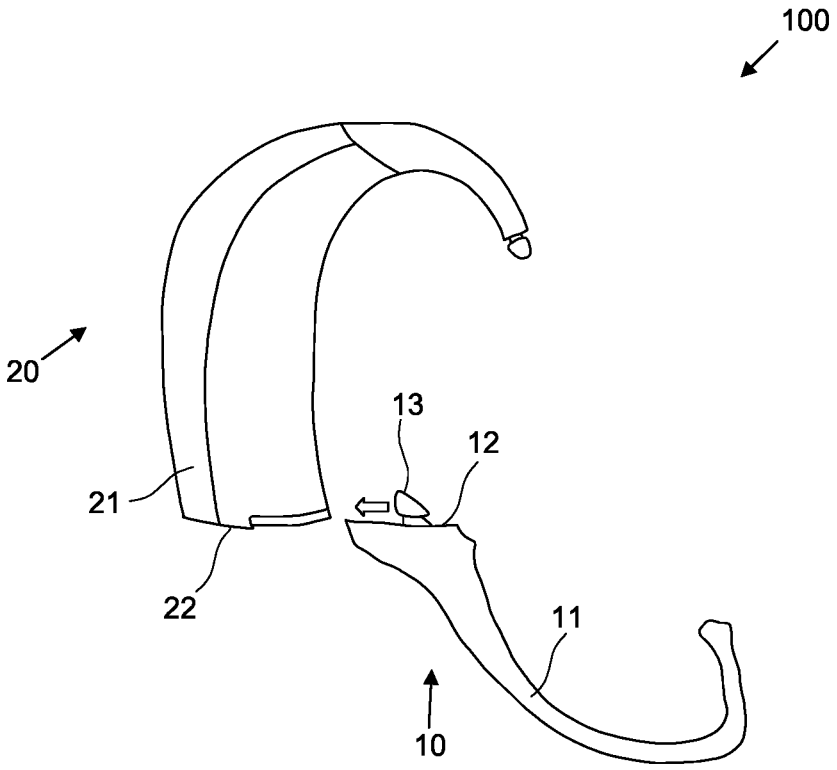
FIG. 3 schematically depicts a side view of another embodiment of a hearing aid retainer accessory.

A hearing aid retainer accessory 10 in FIG. 3 comprises a retainer element 11 with a firm and hook-like shape having a first end face portion 12 with a first mechanical connection means 13 configured as a hook-like protrusion to be engageable to a mechanical connection terminal 23, which is designed as a cut-out region (to be seen best in FIG. 4) of a longitudinal end face portion 22 of a housing 21 of a hearing aid 20. The first end face portion 12 has a surface area of roughly the same size as the longitudinal end face portion 22 of the hearing aid's 20 housing 21.

A Hearing aid assembly 100 is modularly formed by connecting the hearing aid 10 and the hearing aid retainer accessory 20 sliding said components onto each other (indicated by direction arrow next to the first mechanical connection means 13). To establish a connection, a battery drawer 25 of the hearing aid 20 is in an open position. If connected, the first mechanical connection means 13 is engaged to the mechanical connection terminal 23.

Figure 4:
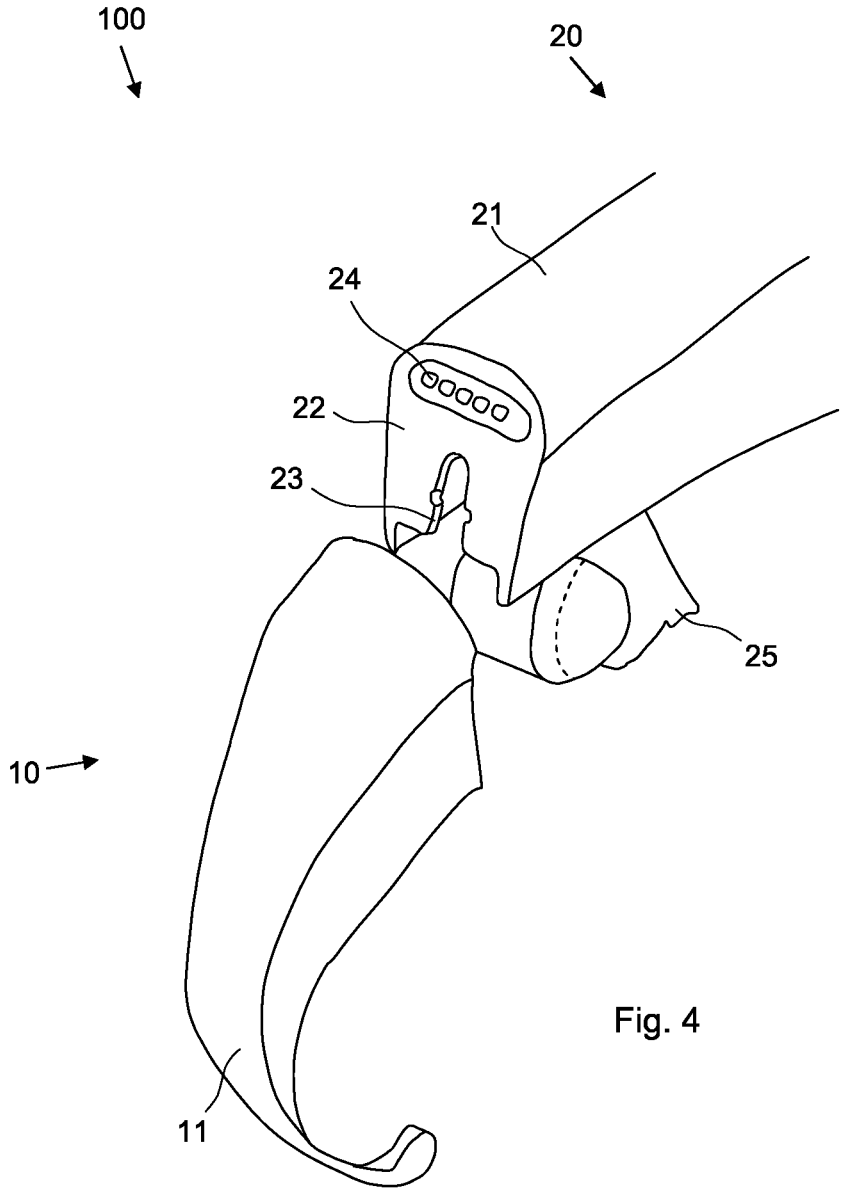
FIG. 4 shows a perspective view of the arrangement of FIG. 3.

FIG. 4 shows a perspective view of the arrangement of FIG. 3 to especially provide a better understanding of the mechanical connection terminal 23 being configured as a cut-out region being complementary to the first mechanical connection means 13 described with respect to FIG. 3 The connection point 24 is configured as connection points being placed on the same surface, namely the longitudinal end face portion 22, as the mechanical connection terminal 23. In this embodiment the no electrical connection between the hearing aid retainer accessory 10 and the hearing aid 20 is established.

Figure 5:
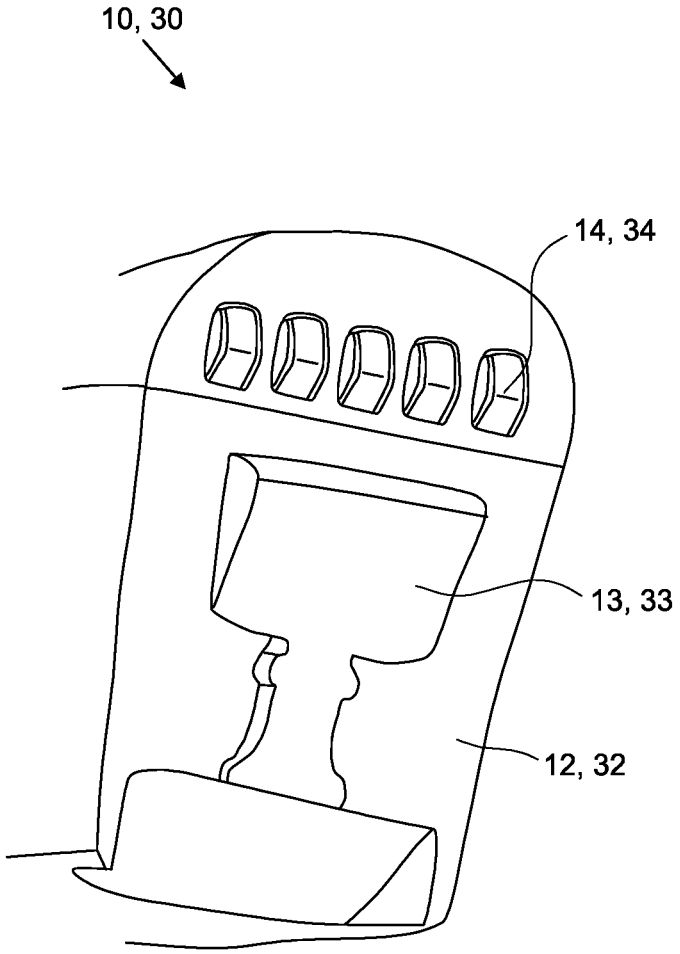
FIG. 5 schematically depicts a detail of a hearing aid retainer accessory's first end face portion and an accessory component's connector portion.

FIG. 5 schematically depicts a detailed view representing both the first end face portion 12 of the hearing aid retainer accessory 10 from FIG. 1 and FIG. 2 and the connector portion 32 of the accessory component 30 from FIG. 1 and FIG. 2 likewise. The first end face portion 12 comprises a first mechanical connection means 13 configured as a hook-like protrusion placed on the same surface with a comprised first electrical connection means 14 configured as connection points. Likewise the connector portion 32 comprises a mechanical connector 33 configured as a hook-like protrusion placed on the same surface with a comprised an electrical connector 34 configured as connection points.

Figure 6:
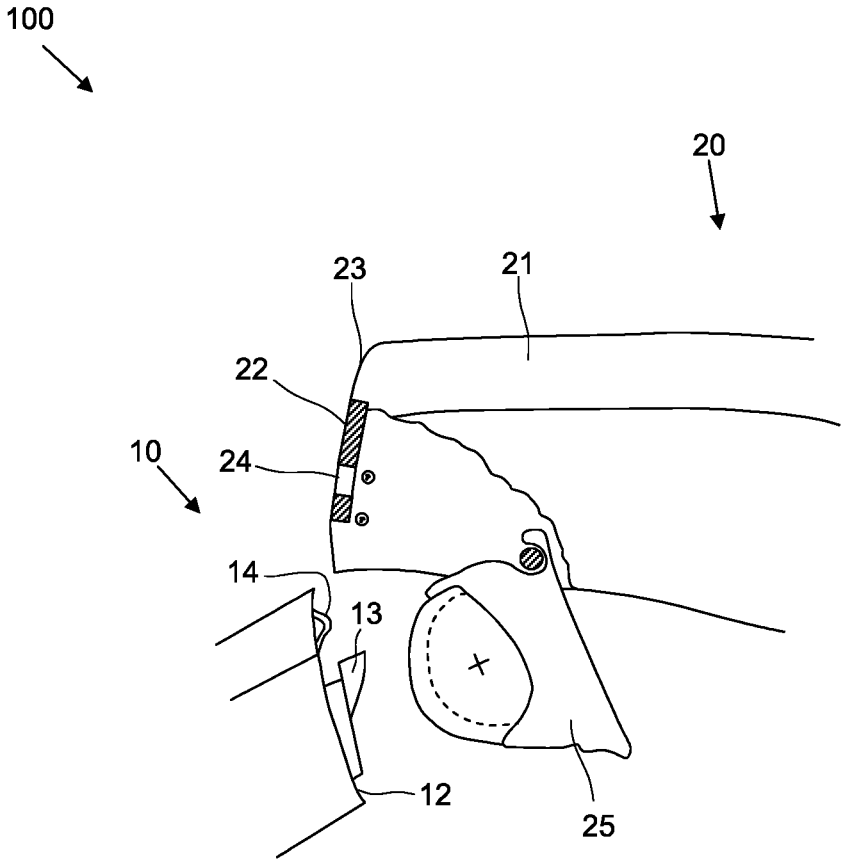
FIG. 6 schematically depicts a side view of a hearing aid retainer accessory about to engage to a hearing aid, where parts of the hearing aid housing are cut away to show internal structures.

In FIG. 6 a hearing aid retainer accessory's 10 is about to be engaged to a hearing aid 20. The descriptions with respect to FIG. 1 and FIG. 2 apply accordingly.

Figure 7:
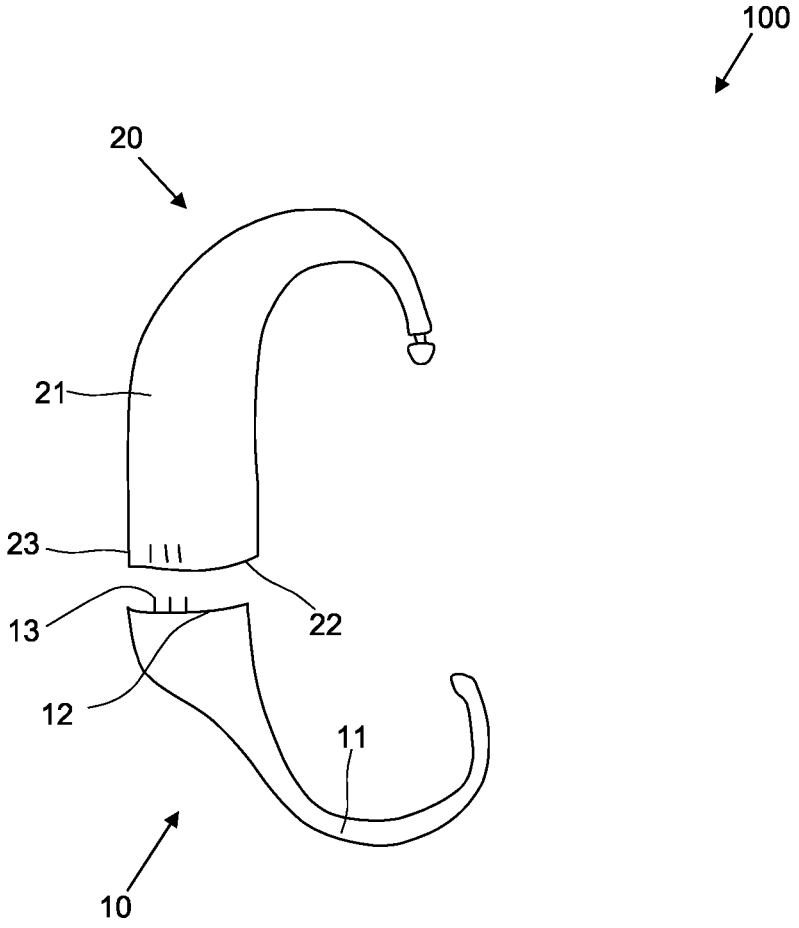
FIG. 7 schematically depicts a hearing aid retainer accessory according to a further embodiment of the current invention.

A hearing aid retainer accessory 10 in FIG. 7 comprises a retainer element 11 having a firm and hook-like shape and comprising a first end face portion 12 with first mechanical connection means 13 configured to be engageable to a mechanical connection terminal 23 of a longitudinal end face portion 22 of a housing 21 of a hearing aid 20. The first mechanical connection means 13 is shaped as a male euro-pin connector. The mechanical connection terminal 23 on the other hand is provided as a female euro-pin connector. Since only a mechanical connection between the hearing aid 20 and the aid retainer accessory 10 is required, the first mechanical connection means 13 is electrically non-conducting.

A Hearing aid assembly 100 is modularly formed by mechanically connecting the hearing aid 10 and the hearing aid retainer accessory 20 pushing said components onto each other. The male euro-pin connector protruding from first end face portion 12 is engaged with the female euro-pin connector located in the longitudinal end face portion 22.

The first end face portion 12 has a surface area of roughly the same size as the longitudinal end face portion 22 of the hearing aid's 20 housing 21.

The invention claimed is:

1. A hearing aid retainer accessory for use with a hearing aid having a housing with a longitudinal end face portion comprising a mechanical connection terminal and an electrical connection point, the hearing aid retainer accessory comprising:

a retainer element including a first end face portion having a first mechanical connector configured to be engageable to the mechanical connection terminal of the longitudinal end face portion of the housing of the hearing aid, and a second end face portion having a second mechanical connector configured to engage a mechanical connector of an accessory component's connector portion, wherein the second mechanical connector is formed as a cut-out region being complementary to the first mechanical connector.

2. The hearing aid retainer accessory according to claim 1, wherein the first mechanical connector is shaped as a hook-like protrusion fitted to a cut-out region embodying the mechanical connection terminal of the longitudinal end face portion of the hearing aid's housing.

3. The hearing aid retainer accessory according to claim 1, wherein the first and the second end face portions comprise respective first and second electrical connectors electrically connected to each other, the first electrical connector is configured to engage an electrical connection point of the longitudinal end face portion of the hearing aid's housing, and the second electrical connector is configured to engage to an electrical connector of the accessory component's connector portion.

4. The hearing aid retainer accessory according to claim 1, wherein the first end face portion has a surface area of roughly the same size as the longitudinal end face portion of the hearing aid's housing and/or the same size as the accessory component's connector portion.

5. The hearing aid retainer accessory according to claim 1, wherein the first and the second end face portions face away from each other and have a surface area of roughly the same size.

6. A hearing aid accessory unit, comprising:

a hearing aid retainer accessory including a retainer element including a first and a second end face portion having a respective first and second mechanical connector, wherein the first mechanical connector is configured to be engageable to a mechanical connection terminal of a longitudinal end face portion of a hearing aid's housing; and an accessory component having a connector portion with a mechanical connector engaged to said second mechanical connector, wherein the first mechanical connector of the hearing aid retainer accessory and the mechanical connector of the accessory component are identically shaped as a hook-like protrusion fitted to a cut-out region embodying the second mechanical connector.

7. The hearing aid accessory unit according to claim 6, wherein the first and the second end face portions comprise respective first and second electrical connectors electrically connected to each other, wherein the first electrical connector is configured to engage to an electrical connection point of the longitudinal end face portion of the hearing aid's housing, and the second electrical connector is engaged to an electrical connector comprised by the accessory component's connector portion.

8. The hearing aid accessory unit according to claim 6, wherein the first and the second end face portions face away from each other and have a surface area of roughly the same size as the connector portion.

9. A hearing aid assembly, comprising:

a hearing aid including a housing with a longitudinal end face portion including a mechanical connection terminal and an electrical connection point;

a hearing aid retainer accessory including a retainer element with a first and a second end face portion having a respective first and second mechanical connector, wherein the first mechanical connector is engaged to the mechanical connection terminal; and an accessory component including a connector portion with a mechanical connector engaged to said second mechanical connector, wherein the first mechanical connector of the hearing aid retainer accessory and the mechanical connector of the accessory component are identically shaped as a hook-like protrusion fitted to a cut-out region embodying the second mechanical connector and the mechanical connection terminal.

10. The hearing aid assembly according to claim 9, wherein the first and the second end face portions comprise respective first and second electrical connectors electrically connected to each other, the first electrical connector is engaged to the electrical connection point, and the second electrical connector is engaged to an electrical connector comprised by the accessory component's connector portion.

11. The hearing aid assembly according to claim 9, wherein the first and the second end face portions face away from each other and have a surface area of roughly the same size as the connector portion and the longitudinal end face portion.

* * * * *